US005082159A

United States Patent [19]

Gutierrez

[11] Patent Number: 5,082,159

[45] Date of Patent: Jan. 21, 1992

[54] SUBSTANDARD SIZE FOOD WRAP DISPENSER

[76] Inventor: Concetta M. Gutierrez, 23 Royal Oak Rd., Lawrenceville, N.J. 08648

[21] Appl. No.: 478,960

[22] Filed: Feb. 12, 1990

[51] Int. Cl.[5] ..... B65H 75/28; B26F 3/02

[52] U.S. Cl. ..... 225/34; 225/47

[58] Field of Search ..... 225/34, 48, 49, 47; 242/55.3, 55.53

[56] References Cited

U.S. PATENT DOCUMENTS

| | | | |
|---|---|---|---|
| 958,062 | 5/1910 | Adkins | 242/55.3 |
| 1,268,222 | 6/1918 | Dwyer | 242/55.3 |
| 3,281,032 | 10/1966 | Solomon | 225/34 |
| 3,371,880 | 3/1968 | Clisham | 242/55.3 |
| 4,025,004 | 5/1977 | Massey | 242/55.3 |
| 4,238,065 | 12/1980 | Ragsdale | 225/48 |

*Primary Examiner*—Hien H. Phan

*Attorney, Agent, or Firm*—W. L. Muckelroy; Iman Abdallah

[57] ABSTRACT

Household food wraps are commercially available in a standard 12" nominal width roll. The present invention provides an article of manufacture for dispensing narrower strips of food wrap. The food wrap dispenser of the present invention includes a quadrilateral carton and a roll divider for receipt of a plurality of substandard size rolls of food wrap. A method of selectively converting standard size rolls of food wrap to substandard size rolls is also disclosed.

1 Claim, 2 Drawing Sheets

SUBSTANDARD SIZE FOOD WRAP DISPENSER

BACKGROUND OF THE INVENTION

The present invention generally relates to food wrap dispensers. More particularly, the present invention relates to dispensers for substandard widths of household food wraps.

Household food wraps of the prior art include waxed paper, aluminum foil and plastic film. These food wraps are made available to the public for household uses in a standard 12" nominal-width roll housed in a quadrilateral carton dispenser having a serrated tear edge. A present difficulty in the food wrap dispensers of the prior art is the absence of means to dispense a narrower strip of food wrap. Efforts to cut or tear a standard size length of food wrap to form a narrower strip is particularly problematic when the film-type food wrap is used because of its "cling" properties. Furthermore, using the standard width food wrap on small containers or small food items results in substantial wastes of material. Various improvements in food wrap dispensers have been disclosed in the prior art but none of the improvements identified by the Applicant have been directed to means for dispensing substandard size widths of food wrap material.

The prior art improvements in food wrap dispensers have generally been directed to only three aspects of the dispenser: (1) means for constructing the dispenser carton, (2) means for removing the wrap from the carton, and (3) wrap tearing means. In U.S. Pat. No. 4,371,104 to Korte improvements in carton construction to reinforce points of stress concentration is disclosed. U.S. Pat. No. 4,399,935 to Nelder discloses improvements in the method of forming dispensing cartons and the wrap tear edge. A unitary carton having a finger depression to facilitate removal of the wrap from a carton is disclosed in U.S. Pat. No. 2,115,891 to Tishler. In U.S. Pat. No. 3,531,032 to Miles a wrap dispenser having improved finger grasping means is shown. Wrap tearing improvements in the prior art include U.S. Pat. No. 1,887,912 to Begle wherein a tearing edge treated with an indurating agent is disclosed; U.S. Pat. No. 4,005,809 to Finn wherein a tearing edge formed from an abrasive adhesive is disclosed; U.S. Pat. No. 4,426,029 to Kamp wherein a tearing edge is formed from a plurality of spaced-apart sharp piercing teeth disposed below and between a plurality of spaced-apart blunt projections; and U.S. Pat. No. 4,450,996 to Kamp wherein a tearing edge comprising a plurality of spaced-apart members having a blunt upper edge and side-extending teeth is disclosed.

As previously noted, these improvements in food wrap dispensers do not address the problems of providing substandard size widths of wrap for household use.

SUMMARY OF THE INVENTION

The present invention discloses a food wrap dispenser for substandard size widths of household food wrap comprising a quadrilateral carton having a serrated tearing edge formed in the front wall of the carton and a roll divider disposed within said carton to separate substandard size rolls of food wrap. The present invention also includes a method of selectively converting standard size rolls of food wrap to one or a plurality of substandard size rolls.

An object of the present invention is to provide a food wrap dispenser for substandard size widths of household food wrap.

Another object of this invention is to provide a food wrap dispenser for a plurality of rolls of food wrap of varying widths.

It is also an object of the present invention to provide a food wrap dispenser that prevents the waste of material resulting from wrapping small containers and small food items with oversized food wrap.

A further object of the present invention is to provide a method of adapting standard size rolls of food wrap to the substandard size food wrap dispenser disclosed herein.

These and other objects and advantages of the present disclosure will be apparent to those skilled in the art from the following description of the preferred embodiments, claims and accompanying drawings.

DESCRIPTION OF PREFERRED EMBODIMENTS

Figure 1:
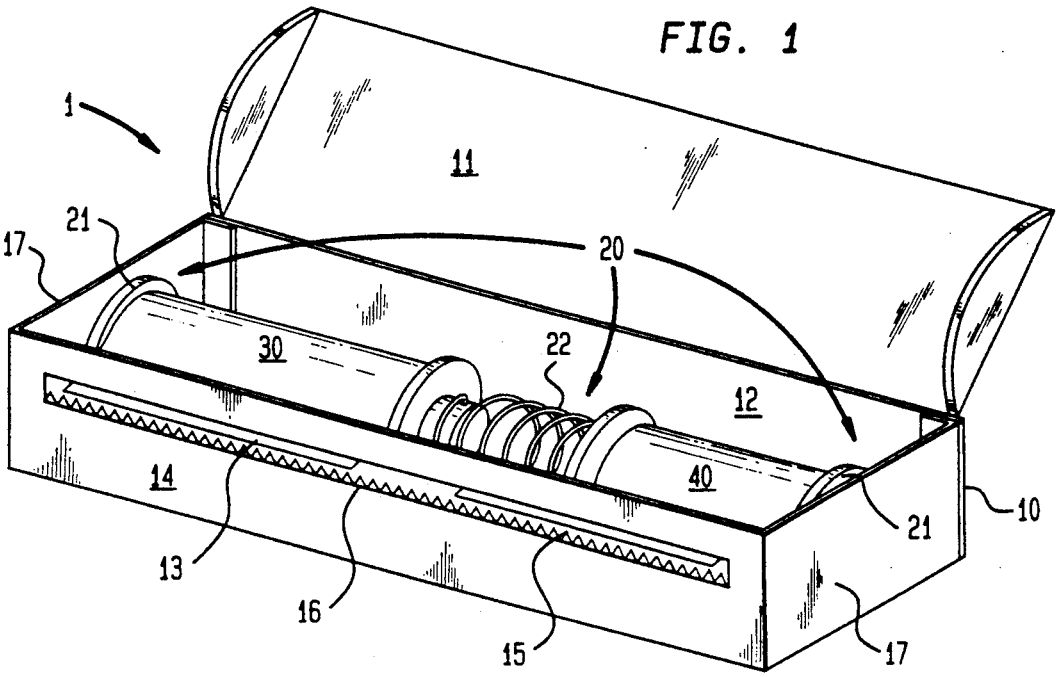
FIG. 1 is a front perspective view of a first preferred embodiment of the food wrap dispenser of the present invention.

FIG. 1 illustrates in a front perspective view a first preferred embodiment of the food wrap dispenser 1 of the present invention. Dispenser 1 generally comprises a quadrilateral carton 10 having an integrally formed dust flap 11 hingedly attached to the top edge of the rear wall 12 of said carton 10, and a dispensing slot 13 formed in the front wall 14 of said carton 10, said slot 13 having a serrated wrap tearing edge 15 fixedly disposed at the lower edge 16 of said slot 13. A plurality of substandard size rolls of food wrap 30, 40 are disposable within said carton 10, said rolls of food wrap 30, 40 being rotatably attachable to said carton 10 by means of a roll divider 20.

Figure 2:
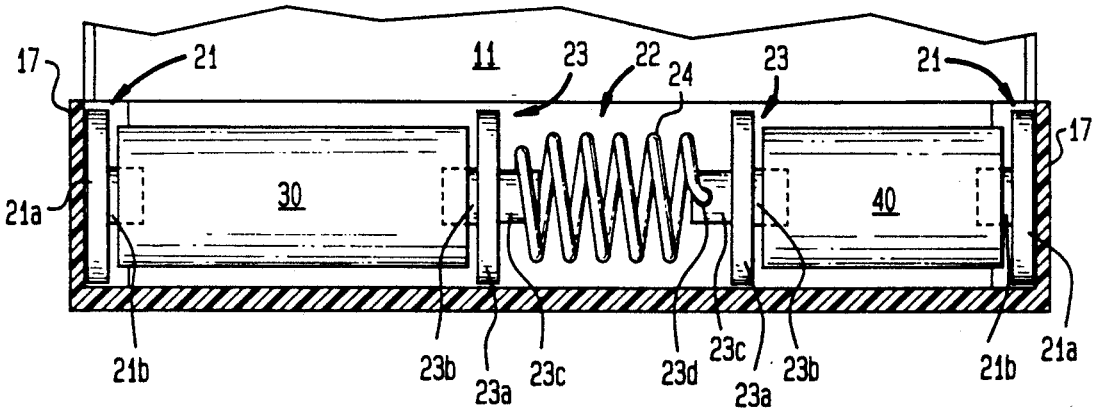
FIG. 2 is a front plan view of the interior portion of the first preferred embodiment shown in FIG. 1.

As best seen in the front plan view of the first preferred embodiment shown in FIG. 2, roll divider 20 comprises roll attachment end members 21 fixedly attached to the inside portion of the side walls 17 of said carton 10 and a roll attachment intermediate member 22 disposed between said rolls of food wrap 30 and 40. Each roll attachment end member 21 comprises a disc-shaped base member **21*a* having an integrally formed annular ring protrusion 21*b* disposed to the inward side of said base member 21*a*, said protrusion 21*b* being provided for receipt of an end of the respective rolls of food wrap 30, 40 in rotatable engagement. Said intermediate member 22 comprises a pair of divider attachment members 23 and an outwardly-biased spring 24 disposed between said divider attachment members 23, said spring 24 being fixedly attached at its ends to the respective divider attachment members 23. Divider attachment members 23 include a central disc 23*a* having an integrally formed annular ring protrusion 23b, similar to the ring protrusion 21b of said end members 21, disposed to one side of said central disc 23a, and an integrally formed spring attachment protrusion 23c disposed to the opposite side of said central disc 23a. The spring attachment protrusion 23c includes a spring attachment orifice 23d for receipt of a bent end of said spring 24**.

Figure 3:
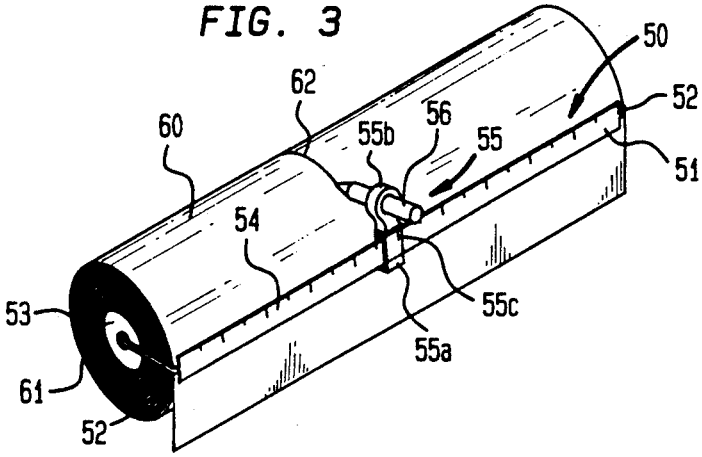
FIG. 3 is a front perspective view of the wrap marking device of the present invention.
Figure 4:
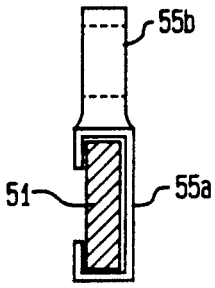
FIG. 4 is a side plan view of the pencil guide of the wrap marking device.

The food wrap dispenser 1 of the present invention provides means for dispensing food wrap of various substandard widths. Due to the commercial practice of providing food wrap in 12" nominal-width rolls, a simple and practical means of selectively adapting standard width rolls to substandard widths is required. In FIG. 3 a wrap marking device 50 is shown attached to a standard size roll of food wrap 60, said marking device 50 being provided to facilitate wrap width selectivity. Wrap marking device 50 generally comprises a straight edge 51 which extends laterally for the width of said standard roll of food wrap 60, said straight edge 51 having roll attachment arms 52 integrally formed at each end of said straight edge 51. The attachment arms 52 are rotatably attached at their distal end to attachment discs 53 which attach in snug engagement with the food wrap spindle 61. Marked graduations 54 are formed on the face of said straight edge 51 for measuring the desired substandard width. A pencil guide 55 is slidably mounted on the straight edge 51, said pencil guide 55 comprising a guide base 55a, preferably formed of a transparent plastic, and a pencil holder 55b integrally formed to the top portion of said guide base 55a for receipt of a marking pencil 56. The pencil holder 55b is an annular member and as can be best seen in the side plane view of the pencil guide 55 shown in FIG. 4 the guide base 55a is a C-shaped member. Referring again to FIG. 3 it can be seen that a datum line 55c is disposed on the face of said guide base 55a to permit alignment of said pencil 56 at selectively measured positions along said straight edge 51. With the pencil guide 55 selectively positioned along said straight edge 51 the tip of the pencil 56 is placed against the surface of said standard roll of food wrap 60 and the marking device 50 is then rotated about said standard roll 60 while holding the pencil 56 at the desired position to mark a line 62 about the outside surface of said food wrap 60. The standard roll 60 is then sawed or cut along the line 62 (or lines) to form a plurality of substandard size rolls of food wrap 30, 40.

Figure 5:
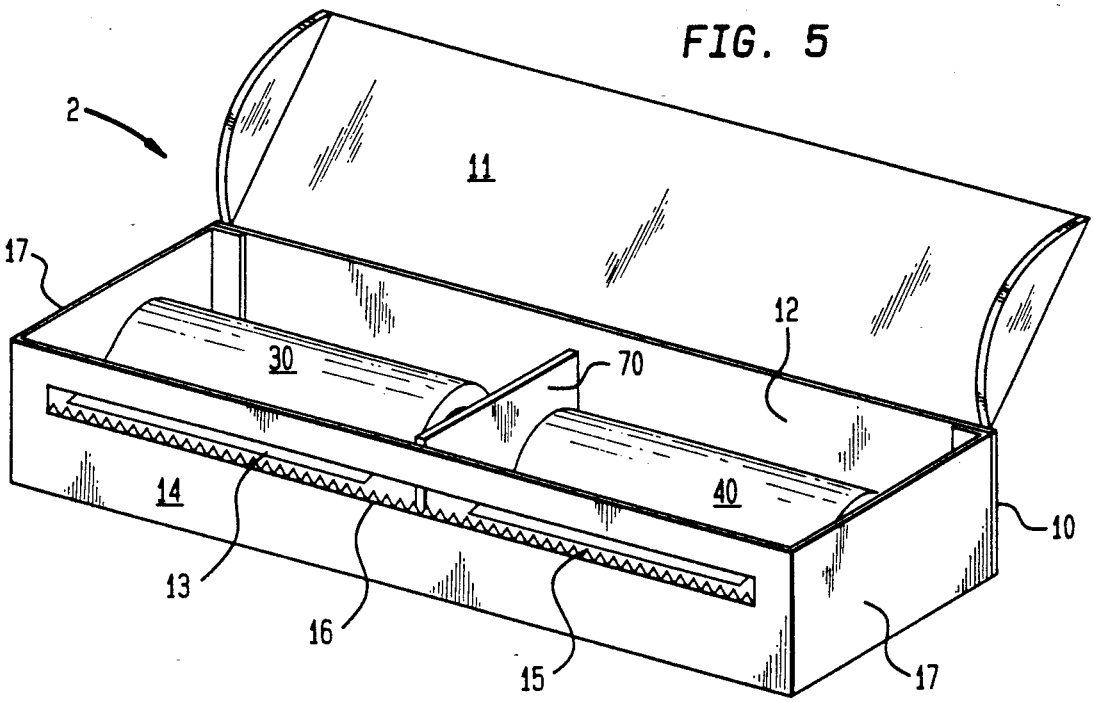
FIG. 5 is a front perspective view of a second preferred embodiment of the food wrap dispenser of the present invention.
Figure 6:
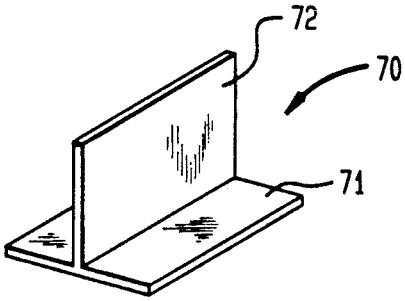
FIG. 6 is a perspective view of the roll divider of the second preferred embodiment.

FIG. 5 illustrates in a front perspective view a second preferred embodiment of a food wrap dispenser 2 constructed in accordance with the teachings of the present invention. The wrap dispenser carton 10 of the second preferred embodiment is formed in the same manner as previously described for the first preferred embodiment 1 and similar numerals in FIG. 5 indicate the like members as shown in FIGS. 1 and 2 and previously described. The roll divider 70 of the second preferred embodiment is slidably disposed adjacent to the floor of said dispenser carton 10 and as can be best seen in the perspective view shown in FIG. 6, the roll divider 70 comprises an inverted T-shaped member 70, preferably formed of plastic material, the head 71 of said T-shaped member forming the foot of said divider 70 and the stem 72 of said divider 70 forming the roll dividing wall.

Various changes, additions and deletions can be made to the preferred embodiments of the present invention without departing from the spirit and scope of the teachings of the present disclosure and such changes, additions and deletions are intended to be included within the scope of the appended claims. Furthermore, the present invention includes a food wrap dispenser carton 10 as previously described formed in a substandard size width for receipt of a substandard size roll of food wrap 30 or 40.

Therefore in view of the foregoing I claim:

1. A food wrap dispenser for substandard size widths of household food wrap comprising a quadrilateral carton having a serrated tearing edge and at least one roll divider disposed within said carton to separate substandard size rolls of food wrap wherein said roll divider comprises roll attachment end members fixedly attached to the inside portion of the side walls of said carton and an intermediate roll attachment member disposed between said rolls of food wrap, each of said roll attachment end members comprising a disc-shaped base member having an inward side and having an integrally formed annular ring protrusion disposed to the inward side of said base member, said protrusion being provided for attachment of an end of the respective rolls of food wrap in rotatable engagement, said intermediate roll attachment member comprising a pair of divider attachment members and an outwardly-biased spring disposed between said divider attachment members, said spring being fixedly attached at its ends to the respective divider attachment members, each of said divider attachment members including a central disc having an integrally formed annular ring protrusion disposed to one side of said central disc and an integrally formed spring attachment protrusion disposed to the opposite side of said central disc, and spring attachment protrusion including a spring attachment orifice for receipt of a bent end of said spring.

* * * * *